US005327602A

United States Patent [19]

Stenger

[11] Patent Number: 5,327,602

[45] Date of Patent: Jul. 12, 1994

[54] COMBINATION PLIERS AND SPANNER WRENCH

[75] Inventor: Tracy K. Stenger, Rockford, Ill.

[73] Assignee: Johnson Enterprises, Inc., Rockford, Ill.

[21] Appl. No.: 137,914

[22] Filed: Oct. 19, 1993

[51] Int. Cl.[5] ..... B25F 1/00

[52] U.S. Cl. ..... 7/125; 7/138; 81/176.2

[58] Field of Search ..... 7/125, 127, 138; 81/176.1, 176.2

[56] References Cited

U.S. PATENT DOCUMENTS 478,121 7/1892 Miller et al. ..... 81/176.1
1,321,777 11/1919 Stephanian ..... 7/127
2,000,012 5/1935 Cullen ..... 7/125
2,071,897 2/1937 Pazzano ..... 7/127

FOREIGN PATENT DOCUMENTS 1021876 12/1952 France ..... 7/127
10501185 8/1953 France ..... 7/127
1364053 5/1964 France ..... 7/138

*Primary Examiner*—Roscoe V. Parker
*Attorney, Agent, or Firm*—Leydig, Voit & Mayer

[57] ABSTRACT

A spanner wrench is clamped to one component of a conventional pair of pliers and is prevented from turning relative to that component by the same pivot element which pivotably connects the two plier components to one another.

7 Claims, 2 Drawing Sheets

COMBINATION PLIERS AND SPANNER WRENCH

BACKGROUND OF THE INVENTION

In taverns and bars which dispense draft beer, several hand tools are required in order to assemble and disassembly various components of the dispensing equipment. Tools which are typically used include pliers, a screwdriver, an adjustable wrench and a spanner wrench. The spanner wrench is a specialized tool which is used to screw a dispensing faucet onto and off of a beer dispensing line. The faucet must be removed from the line at frequent intervals for purposes of cleaning the faucet.

The need to have several tools at a bar is an inconvenience, both from the standpoint of storing the tools in the bar area and from the standpoint of finding the proper tool for the proper job.

SUMMARY OF THE INVENTION

The general aim of the present invention is to provide a combination tool comprising at least a pair of pliers and a spanner wrench so as to reduce the number of separate tools required at a bar.

A more detailed object of the invention is to achieve the foregoing by providing a pair of pliers whose pivot element supports a spanner wrench and prevents turning of the wrench relative to one of the handles of the pliers, the plier handles also serving as a handle for the spanner wrench.

Another object of the invention is to provide a combination tool of the above type in which the handles of the pliers also carry a screwdriver blade and/or an adjustable wrench.

These and other objects and advantages of the invention will become more apparent from the following detailed description when taken in conjunction with the accompanying drawings.

Figure 1:
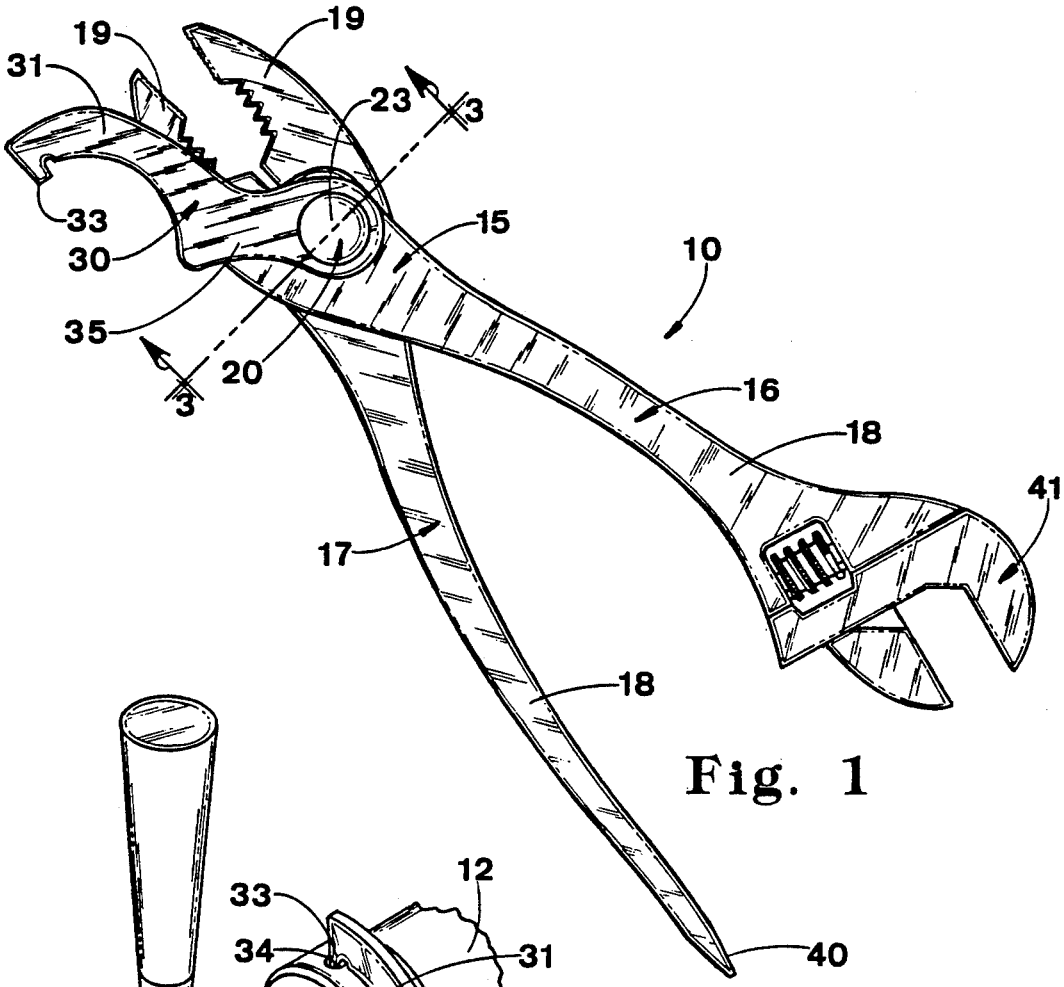
FIG. 1 is a top plan view of a new and improved combination tool incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as embodied in a combination tool 10 which is especially useful at a bar for purposes of assembling and disassembling the components of a draft beer dispensing system. One such component is a dispensing faucet 11 (FIG. 2) which is adapted to be screwed onto and off of a beer dispensing line 12. While the tool 10 is particularly useful at a bar, it may, of course, be utilized in other environments.

The heart of the tool 10 is a pair of pliers 15 having two pivotally interconnected members 16 and 17. Each of the members includes an elongated handle 18 having a serrated jaw 19 at one end thereof. The two members are pivotally interconnected adjacent the jaws by a pivot element 20.

Figure 4:
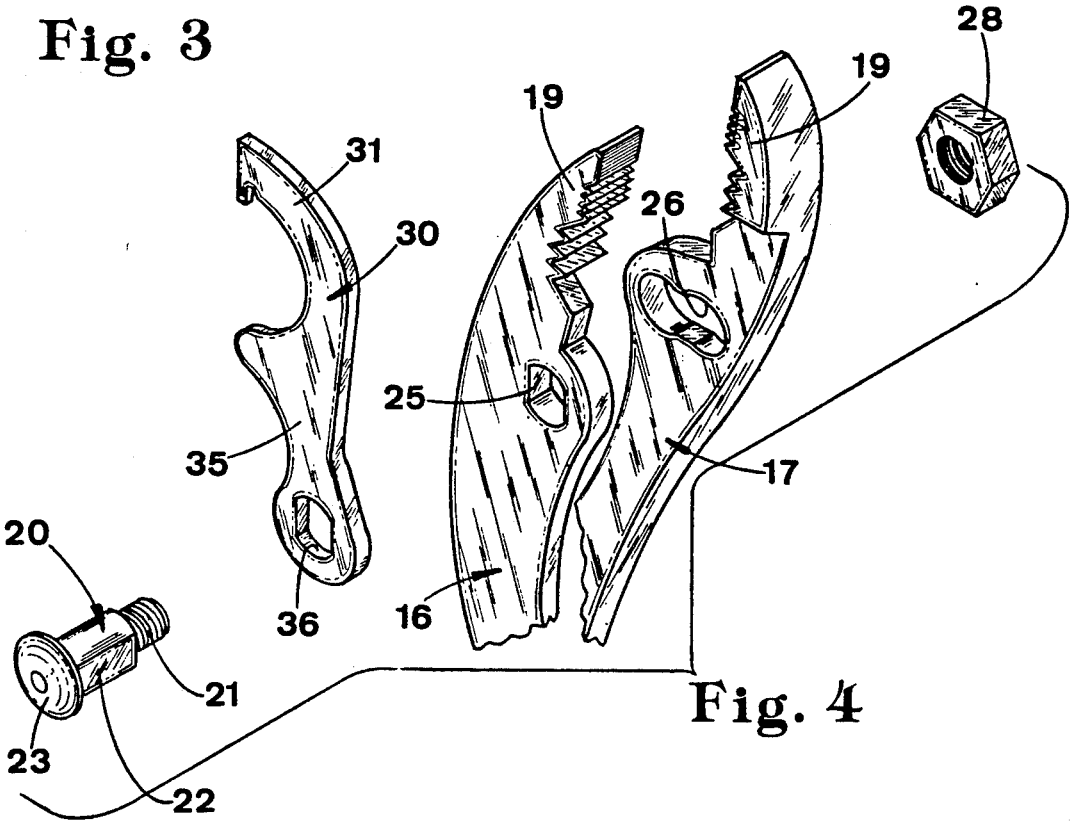
FIG. 4 is an exploded perspective view of certain components of the tool.

In this particular instance, the pivot element 20 is a screw having a shank with a threaded end portion 21 (FIG. 4) and with a non-circular unthreaded portion 22 located between and formed integrally with the threaded portion and an enlarged head 23. Herein, the non-circular portion 22 of the shank is of double-D shape and includes two generally straight and parallel sides joined by two convexly curved ends (see FIG. 4).

Formed through the member 16 of the pliers 15 adjacent the jaw 19 thereof is a hole 25 having the same double-D shape as the shank portion 22 of the screw 20. A generally figure-8 shaped hole 26 is formed through the member 17 and is aligned generally with the hole 25. When the screw 20 is assembled with the members 16 and 17, the non-circular portion 22 of the shank is located within the holes 25 and 26 while the threaded portion 21 of the shank extends beyond the member 17 and into a nut 28. The non-circular portion 22 of the shank prevents turning of the member 16 on the screw 20. The member 17 may be pivoted on the non-circular portion to open and close its jaw 19 relative to the other jaw and also may be adjusted transversely of the screw to adjust the initial and final spacing between the jaws.

In accordance with the present invention, the screw 20 also serves to attach a spanner wrench 30 to the member 16 so that the tool 10 is capable not only of functioning as pliers but also may perform a specialized wrenching function. In this particular instance, the spanner wrench is especially adapted to tighten the faucet 11 on and loosen the faucet from the beer line 12.

Figure 2:
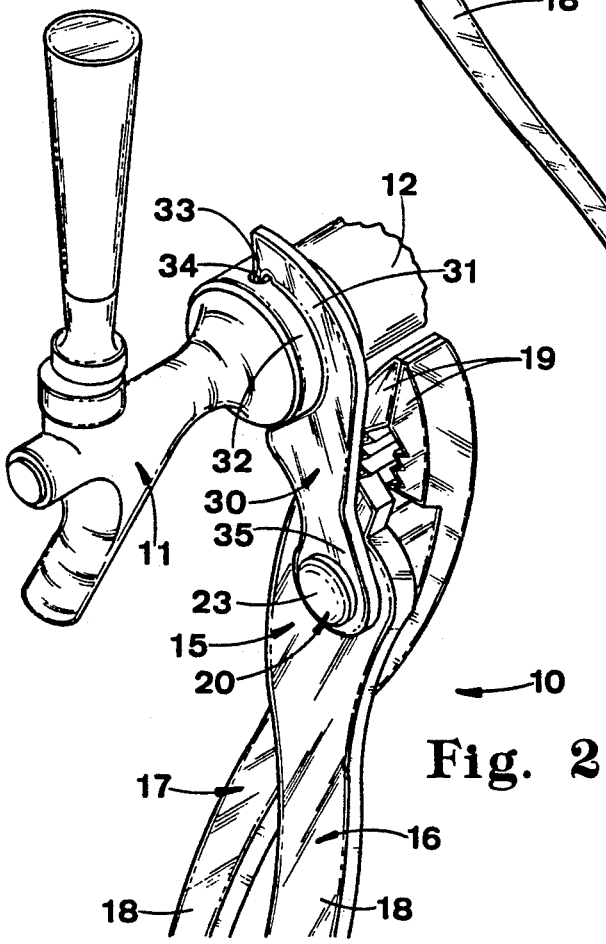
FIG. 2 is a perspective view showing the spanner wrench of the tool being used to install a beer dispensing faucet.
Figure 3:
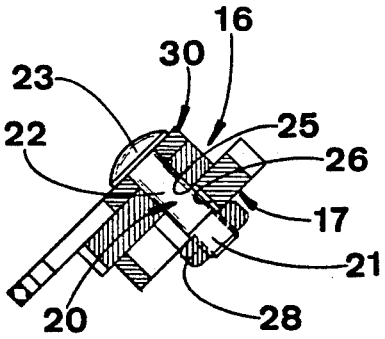
FIG. 3 is a cross-section taken substantially along the line 3—3 of FIG. 1.

More specifically, the spanner wrench 30 is made from a flat piece of steel and includes a curved wrenching portion 31 adapted to embrace part of the female fitting 32 (FIG. 2) of the faucet 11. Formed integrally with and projecting inwardly from the free end of the curved portion is a dog 33 adapted to be received in a hole 34 in the fitting 32. When the spanner wrench is positioned as shown in FIG. 2, the dog effects loosening of the faucet fitting when the wrench is turned clockwise.

Pursuant to the invention, the spanner wrench 30 includes a mounting portion 35 formed with a hole 36 (FIG. 4) of substantially the same size and shape as the double-D hole 25 in the member 16. The mounting portion 35 of the wrench is sandwiched between the member 16 and the head 23 of the screw 20 and receives the non-circular portion 22 of the screw shank. When the nut 28 is tightened, the mounting portion 35 of the wrench is clamped tightly between the member 16 and the head 23 and is prevented from turning relative to those components by the coaction of the non-circular shank portion 22 and the complementary shaped hole 36.

With the foregoing arrangement, the handles 18 of the pliers 15 also serve as handles for the spanner wrench 30 to enable substantial leverage to be applied to the relatively short wrench. By virtue of being attached to the pliers, the wrench is less likely to be misplaced and, in addition, only one tool need be purchased and stored rather than two separate tools.

Figure 5:
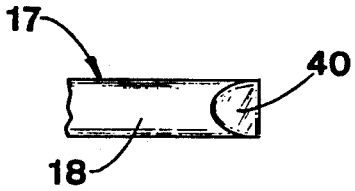
FIG. 5 is a view showing the screwdriver blade.

The versatility of the tool 10 is increased further by grinding the free end portion of the handle 18 of the member 17 in such a manner as to form a screwdriver blade 40 (FIGS. 1 and 5) at the end of the handle. In addition, an adjustable wrenching head indicated generally by the reference numeral 41 is carried by the free end portion of the handle 18 of the member 16. Thus, the tool 10 also eliminates the need for a separate screwdriver and a separate adjustable wrench.

From the foregoing, it will be apparent that the present invention brings to the art a combination tool 10 in which the conventional pivot element 20 of the pliers 15 also is used to clamp and prevent turning of the spanner wrench 30 so that both the pliers and the spanner wrench may be purchased, used and stored as a single unit. While the pivot element has been specifically disclosed as being a screw with a nut 28, it should be appreciated that other forms of pivot elements (e.g., a headed pin with a swaged end) may be used. In addition, the end portion of the screw 20 opposite the threaded portion 21 also may be threaded to receive a nut rather than having an integral head 23, in which case the latter nut would define a head.

I claim:

1. A combination tool comprising two members each having an elongated handle and a serrated jaw, pivot means pivotally connecting said members together near said jaws whereby said members define a pair of pliers, and a wrench clamped against one of said members by said pivot means, said pivot means including means for preventing said wrench from turning relative to said one member.

2. A combination tool as defined in claim 1 in which said wrench is a spanner wrench having a curved portion and having a dog projecting from said curved portion.

3. A combination tool comprising two members each having an elongated handle and a serrated jaw, a pivot element pivotally connecting said members together near said jaws whereby said members define a pair of pliers, said pivot element including a shank and a head with a portion of said shank adjacent said head being non-circular, a spanner wrench having a mounting portion formed with an opening which is generally complementary in size and shape to the non-circular portion of said shank, said mounting portion of said wrench being clamped between said head and one of said members with said non-circular section of said shank extending into said opening to prevent said wrench from turning relative to said one member.

4. A combination tool as defined in claim 3 in which said shank portion and said opening each include a pair of generally straight and parallel sides and a pair of curved ends extending between said sides.

5. A combination tool as defined in claim 3 further including a screwdriver blade formed on the end of the handle of one of said members.

6. A combination tool as defined in claim 3 further including an adjustable wrench on the end of the handle of one of said members.

7. A combination tool as defined in claim 6 further including a screwdriver blade formed on the end of the handle of the other of said members.

* * * * *